US008057326B2

(12) United States Patent
Woodbury

(10) Patent No.: US 8,057,326 B2
(45) Date of Patent: Nov. 15, 2011

(54) GOLF BALL MARKER

(76) Inventor: Robert Woodbury, Scottsdale, AZ (US)

( * ) Notice: Subject to any disclaimer, the term of this patent is extended or adjusted under 35 U.S.C. 154(b) by 270 days.

(21) Appl. No.: 12/369,635

(22) Filed: Mar. 20, 2009

(65) Prior Publication Data

US 2010/0125008 A1 May 20, 2010

Related U.S. Application Data

(60) Provisional application No. 61/114,996, filed on Nov. 14, 2008.

(51) Int. Cl.
*A63B 57/00* (2006.01)

(52) U.S. Cl. ..... 473/406

(58) Field of Classification Search ..... 473/406, 473/405, 407, 285; D21/793, 794
See application file for complete search history.

(56) References Cited

U.S. PATENT DOCUMENTS

| | | | | | |
|---|---|---|---|---|---|
| 2,178,872 | A | | 11/1939 | Engstrom | |
| 3,310,879 | A | * | 3/1967 | Brzezinski et al. | 473/131 |
| 3,622,157 | A | | 11/1971 | Hatch | |
| 3,685,168 | A | * | 8/1972 | Reitz | 473/405 |
| 3,895,797 | A | * | 7/1975 | Moore | 473/406 |
| 4,521,018 | A | | 6/1985 | Cotchonis | |
| 4,858,925 | A | * | 8/1989 | DeStefano, Jr. | 473/285 |
| 5,282,616 | A | | 2/1994 | Stacavich-Notaro | |
| 5,529,299 | A | * | 6/1996 | Bellagamba | 473/285 |
| 5,569,103 | A | * | 10/1996 | Sihn | 473/406 |
| 5,860,876 | A | * | 1/1999 | Guffey | 473/405 |
| 6,017,282 | A | * | 1/2000 | Stefonsky | 473/406 |
| 6,027,417 | A | * | 2/2000 | Zoretic et al. | 473/407 |
| D421,342 | S | * | 3/2000 | Smith | D21/794 |
| D456,869 | S | * | 5/2002 | Carroll, Jr. | D21/793 |
| 6,386,995 | B1 | | 5/2002 | Jastram | |
| D480,444 | S | * | 10/2003 | Marchessault et al. | D21/794 |
| 7,120,972 | B2 | | 10/2006 | O'Banion | |
| 7,226,370 | B1 | | 6/2007 | Cope | |
| 2006/0058121 | A1 | * | 3/2006 | Hallock | 473/406 |
| 2007/0123367 | A1 | * | 5/2007 | Brady | 473/406 |
| 2008/0287220 | A1 | * | 11/2008 | Houghton | 473/406 |

* cited by examiner

*Primary Examiner* — Steven Wong
(74) *Attorney, Agent, or Firm* — Keith L. Jenkins, Registered Patent Attorney, LLC; Keith L. Jenkins

(57) ABSTRACT

The golf ball marker has a top side contoured and textured to represent a portion of an actual golf course and a flat bottom side. The flat bottom side has an indicia-receiving surface portion. The top bottom sides are separated by a perimeter that is shaped to enclose representations of the terrains of the portion of the actual golf course. The contoured top side may bear a name of the portion of the actual golf course in lettering, with or without a panel. The lettering is preferably proximate to the perimeter and arranged conformally to the shape thereof. The lettering may be cut in relief. A coupling, which does not extend below the bottom side, is optional. A decoration in or representing the golf hole on the green may be provided. The golf ball marker may be manufactured based on digital data either provided by or selected by the customer.

20 Claims, 8 Drawing Sheets

GOLF BALL MARKER

RELATED APPLICATIONS

This application claims the benefit of U.S. Provisional Application No. 61/114,996 filed Nov. 14, 2008.

FIELD OF THE INVENTION

The present invention relates to golf ball markers. More particularly, the present invention relates to a novel golf ball marker bearing a contoured, or relief, representation of a portion of an actual golf course, and the method and business of producing same.

BACKGROUND OF THE INVENTION

Golf is played on golf courses that include various terrain features, including fairway, rough, woods, water hazards, sand traps (or bunkers), and golf greens (commonly referred to as just "the green"). The golf course is not flat, showing significant contour, or relief. The golf green contains a hole for receiving a golf ball. The object of the game is to move a golf ball from one end of the fairway, delineated as the "tee" into the hole in the golf green at the other end of the fairway by hitting, or stroking, the ball with one or more golf clubs. Usually, more than one stroke of a golf club upon the ball is required to urge the ball into the hole. The game of golf is typically played by more than one person at a time, allowing multiple golf balls on the golf green at one time. The rules of the game of golf provide for the order in which the balls on the green may be played. As a result, balls to be played later are sometimes located in the path of balls to be played sooner, obstructing orderly play. In this situation, the rules provide that the golfer who is to play the obstructing ball must pick up his ball and mark the spot accurately. Golf ball markers are used for this purpose. Golf balls may also be picked up and their places marked if a player thinks that an earlier player might, in the course of missing the hole, impact the later player's golf ball to a less favorable position. Where the golf ball to be picked up is directly in the path of the earlier player's shot, the marker is placed off to the side of, and perpendicular to, a line from the earlier player's ball to the hole. In this manner, the marker itself will not interfere with the earlier player's shot.

Golf ball markers are known in the game of golf as small pieces used to mark a position of a ball on the golf green, although the rules do not limit the size of the golf ball marker. Considerable innovation in design of golf ball markers precedes the present invention.

U.S. Pat. No. 5,569,103 to Sihn for a GOLF BALL MARKER issued on Oct. 29, 1996 disclosing a circular flat disc golf ball marker made of precious metal, such as gold, having, metal facets around the edge, optional faceted gem stones on the top surface, and optional identification symbols on the top surface. Sihn's indicia may be relief indicia. Sihn discloses a substantially spherical stud on the underside of his golf ball marker for securing the golf ball marker to clothing for use as jewelry and for securing the marker to the golf green. Sihn teaches using various surface textures, but only one at a time.

U.S. Pat. No. 2,178,872 to Engstrom for a GOLF CLUB ATTACHMENT AND MARKER issued on Nov. 7, 1939 and discloses a flat disc golf ball marker with a screw-type protrusion from the bottom for alternatively securing the golf ball marker in the end of a golf club or securing the golf ball marker to the golf green.

U.S. Pat. No. 3,622,157 to Hatch for a GOLF GREEN REPAIR TOOL AND GOLF BALL MARKER ASSEMBLY issued on Nov. 23, 1971 and discloses a flat disc golf ball marker with a lower protrusion for alternatively securing the golf ball marker in a golf green repair tool or securing the golf ball marker to the golf green.

U.S. Pat. No. 5,282,616 to Stacavich-Notaro for a GOLF BALL MARKER issued on Feb. 1, 1994 and discloses a flat circular disc golf ball marker with a some element of decoration on a top portion that is attachable with hook and loop fasteners to an attachment component. The attachment component, having a spike, attaches alternatively to the golf green or operates as part of a tie tack.

U.S. Pat. No. 6,386,995 B1 to Jastram for a GOLF BALL POSITION MARKER AND METHOD issue on May 5, 2002 and discloses a flat circular disc golf ball marker having indicia on the top surface and the bottom surface. The top surface indicia are positioning indicia and the bottom surface indicia may be advertising.

U.S. Pat. No. 7,120,972 B2 to O'Banion for a MAGNETIC ATTACHMENT DEVICE AND METHODOLOGY issued on Oct. 17, 2006 and discloses a magnetic clamp that clamps over a portion of apparel and receives a flat circular or regular polygonal golf ball marker having decoration on its top surface and optionally having a raised ridge around the perimeter. O'Banion teaches the use of precious metals and plastic for making the golf ball marker.

U.S. Pat. No. 7,226,370 B1 to Cope for a GOLF BALL POSITION MARKER ASSEMBLY issued on Jun. 5, 2007 and discloses a golf ball marker secured to a functional or decorative accessory. The golf ball marker is magnetically secured to a base for easy access. Cope discloses decorative or functional indicia such as precious stones, decorative etching or enameled ornamentation, the user's name or initials, memorable dates, advertising material, tournament logos, or golf club logos.

The inventors have recognized a need for golf ball markers that have conformal, or relief representations of portions of an actual golf course. In order to meet those needs, and to solve related problems, the inventors have developed the novel golf ball marker of the present invention.

OBJECTS AND FEATURES OF THE INVENTION

A primary object and feature of the present invention is to provide a golf ball marker that is shaped, on its upper surface, like a portion of an actual golf course. It is a further object and feature of the present invention to provide a golf ball marker with lettered indicia of the name of the particular portion of the actual golf course. It is a further object of the invention to provide for the perimeter of the golf ball marker to be shaped adaptively to the features of the portion of the actual golf course represented. It is a further object of the invention to provide a flat bottom portion that is able to receive identification indicia. It is a further object of the invention to provide a jewelry coupling extending from the top portion outwardly from the perimeter. It is yet another object of this invention to provide lettered indicia on the top side that is arranged proximate or conformal to the perimeter. It is yet another object and feature of the present invention to derive the conformal shape of the portion of the actual golf course from digital imagery of the actual golf course. It is still yet another object and feature of the present invention to use digital imagery that is either selected or provided by the person desiring production of the golf ball marker. A further objective of the present invention is to provide a plurality of textures on the conformal representation, each representative of a type of terrain found on a golf course. A further primary object and feature of the present invention is to provide such a golf ball marker that is attractive, memorable, wearable, and handy. Other objects and features of this invention will become apparent with reference to the following descriptions.

SUMMARY OF THE INVENTION

In accordance with a preferred embodiment hereof, this invention provides a golf ball marker including: a top side shaped to form a contoured representation of a portion of an actual golf course; a bottom side having a surface suitable to receive identification indicia; and a perimeter shaped adaptively to the portion of the actual golf course and defining a boundary between the top side and the bottom side. The golf ball marker, wherein the top side includes a name of the portion of the actual golf course in lettering. The golf ball marker, wherein the lettering is arranged proximate to the perimeter. The golf ball marker, wherein the lettering is arranged conformal to the perimeter. The golf ball marker, wherein the lettering is in relief.

The golf ball marker, wherein the perimeter is in a geometric plane. The golf ball marker, wherein the contoured representation of the portion of the actual golf course includes a plurality of textures. The golf ball marker, wherein the plurality of textures includes at least two visually distinct textures from the group of: a golf green, a sand trap, a fairway, a rough, a water hazard, a wooded area, and an environmental obstacle. The golf ball marker, wherein the contoured representation of the portion of the actual golf course includes a representation of a golf green. The golf ball marker, wherein the representation of a golf green includes a representation of a golf hole. The golf ball marker, wherein the representation of a golf hole includes a decoration.

The golf ball marker, wherein the identification indicia includes personal identification indicia. The golf ball marker, wherein the personal identification indicia includes a name of an owner of the golf ball marker or a monogram of an owner of the golf ball marker. The golf ball marker, further including a jewelry coupling extending outward of the perimeter from the top side adjacent to the perimeter. The golf ball marker, wherein the contoured representation of a portion of the actual golf course is derived from digital imagery of the portion of the actual golf course. The golf ball marker, wherein the digital imagery is one of provided and selected by a person desiring to have the golf ball marker produced.

A golf ball marker including: a top side including: a contoured representation of a portion of an actual golf course further including a plurality of textures and a name relating to the portion of the actual golf course in lettering; a bottom side having a surface suitable to receive identification indicia; and a perimeter shaped adaptively to the portion of the actual golf course and defining a boundary between the top side and the bottom side, wherein the lettering is at least one of proximate the perimeter and arranged conformally to the perimeter. The golf ball marker, wherein the contoured representation of the portion of the actual golf course includes a representation of a golf green further including a representation of a golf hole, the representation of a golf hole including a decoration. The golf ball marker, wherein the contoured representation of a portion of the actual golf course is derived from digital imagery of the portion of the actual golf course, wherein the digital imagery is one of provided and selected by a person desiring to have the golf ball marker produced.

A golf ball marker including: a top side including: a contoured representation of a portion of an actual golf course; a name relating to the portion of the actual golf course in relief lettering; and a plurality of visually distinct textures representing various portions of golf course terrain; a bottom side having a surface suitable to receive identification indicia; and a perimeter shaped adaptively to the portion of the actual golf course and defining a boundary between the top side and the bottom side, wherein the lettering is at least one of proximate the perimeter and arranged conformally to the perimeter; a jewelry coupling extending outwardly of the perimeter from the top side adjacent to the perimeter; wherein the contoured representation of the portion of the actual golf course includes a representation of a golf green further including a representation of a golf hole, the representation of a golf hole including a decoration; wherein the contoured representation of a portion of the actual golf course is derived from digital imagery of the portion of the actual golf course, wherein the digital imagery is one of provided and selected by a person desiring to have the golf ball marker produced.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

Where names of golf course terrain types are used with reference numbers herein, the terrain type refers to the representation of that terrain type on the golf ball marker 100, 400, 500, 800, 1100, or other golf ball marker within the scope of this disclosure. For example, "golf green 108" refers to the portion of the golf ball marker 100 that represents a golf green. This convention reduces tedious repetition of the word "representation" throughout the specification. The word "hole" when used alone herein, is used in the ordinary sense of one of eighteen holes in a golf course, including all terrain from the tee to the green and the surrounding terrain, including the first and second cuts of the rough. To refer to the cup on the golf green into which the ball should eventually fall, I have used the term "golf hole" herein, for technical accuracy.

Figure 1:
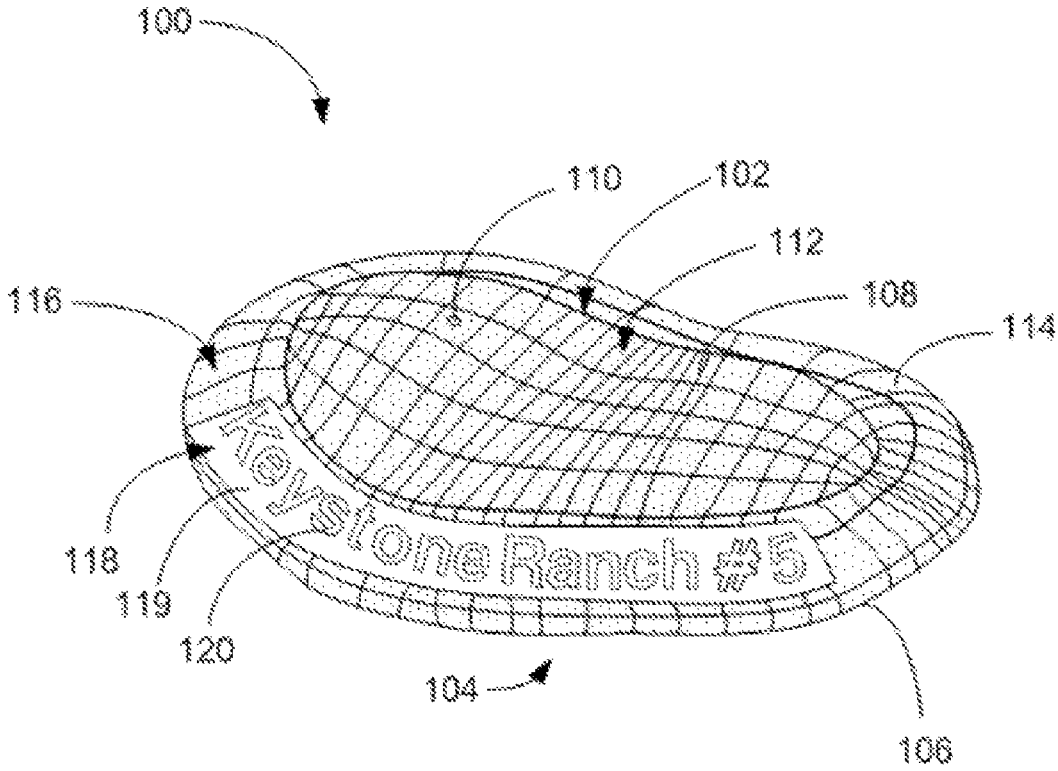
FIG. 1 shows a top perspective view illustrating an exemplary embodiment of a golf ball marker, according to a preferred embodiment of the present invention.

FIG. 1 shows a top perspective view illustrating an exemplary embodiment of a golf ball marker 100, according to a preferred embodiment of the present invention. The contoured top surface 102 represents a portion of an actual golf course. While the portion of the actual golf course being represented shown in FIG. 1 includes a contoured golf apron 114 and a contoured golf green 108, the invention is not so limited. In various other embodiments, the portion of the actual golf course being represented may include an entire hole, or even a plurality of holes. Wire-frame illustration is used to emphasize the contoured top surface 102 representing a contoured golf green 108 and a contoured golf apron 114. A golf hole 110 in the contoured golf green 108 is also provided. Flat bottom surface 104 is not visible in this view. The golf ball marker 100 has an irregular perimeter 106 defining a boundary between the contoured top side 102 and the flat bottom side 104. The shape of perimeter 106 is preferably selected by a designer or by a customer for each particular golf ball marker 100 to be produced.

The name 118 of the particular portion of the actual golf course represented is provided on the contoured top surface 102 of golf ball marker 100 in lettering 120 (one letter of fifteen so labeled). In the view of FIG. 1, the lettering is within a panel 119, which may be a recessed panel 119. In an alternate embodiment, the panel 119 may be omitted. The lettering 120 may be engraved on the panel 119 or may be relief lettering 120. In a preferred embodiment, the portion of contoured top surface 102 devoted to the panel 119 may first be contoured to match the contours of the portion of the actual golf course being represented, then the lettering 120 may be cut into relief along with the formation of the panel 119, leaving the top surfaces of the letters 120 contoured like the portion of the actual golf course being represented. In an alternate preferred embodiment, the panel 119 may be superficial, and the lettering 120 engraved thereon. In yet another preferred embodiment, the lettering 120 and panel 119 may be molded, rather than machined or laser cut.

The lettering 120 is preferably proximate to the perimeter 106 and arranged conformally with the shape of the perimeter 106 to which the lettering 120 is proximate. The panel 119 is also preferably shaped conformally to the perimeter 106, as shown. While the base of the lettering 120 is shown proximate the perimeter 106, the invention is not so limited.

The contoured golf green 108 has a visibly distinct texture 112 from the texture 116 of the golf apron 114. Preferably, each golf ball marker 100 has at least two visibly distinct textures, such as golf green texture 112 and golf apron texture 116. Other portions of a golf course, in addition to or instead of a golf green 108 and a golf apron 114, may be represented and may each have their own distinct textures, as will be discussed in more detail in regard to FIG. 8. In particular alternate embodiments, colors, perhaps by different metals, may be used concurrently with textures 112 and 116.

Golf ball marker 100 is preferably made of a precious metal, such as gold or platinum. In an alternate preferred embodiment, golf ball marker 100 may be made of plastic, ceramic, glass, wood, bone, or other rigid material. In an alternate embodiment, the golf ball marker 100 may be made of a base metal plated with a precious metal. In other alternate embodiments, the golf ball marker 100 may be made of a non-precious metal that is painted, coated, anodized, galvanized, or enameled. The largest dimension of the golf ball marker 100, as measured in top plan view (FIGS. 3-4), is preferably less than the diameter of a golf ball, although the rules of golf make no size limitation, and the present invention is not limited in size except for functional limitations, i.e., a golf ball marker 100 is an item that is easily carried by a golfer during a game of golf.

The location of a golf hole 110 on an actual golf course is moved from time to time, so production of golf ball markers 100 may provide for molding the top side 102 and bottom side 104, while leaving the drilling of golf hole 110 as the final step. In this manner, customers who had memorable success at the course at various times may each select a position for the golf hole 110 that corresponds to the position of the golf hole 110 at the time of their memorable success.

Figure 2:
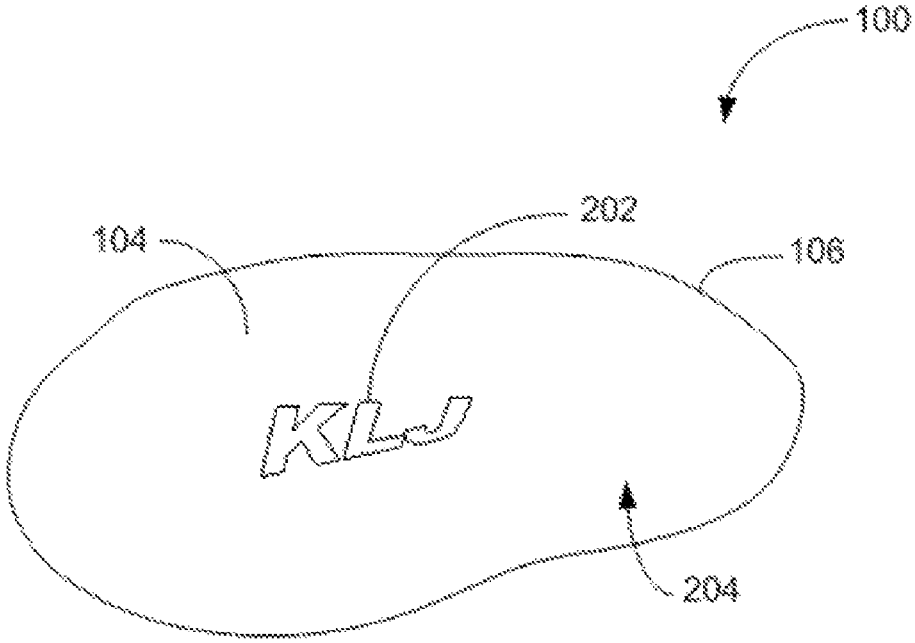
FIG. 2 shows a bottom perspective view illustrating the exemplary golf ball marker of FIG. 1, according to a preferred embodiment of the present invention.

FIG. 2 shows a bottom perspective view illustrating the exemplary golf ball marker 100 of FIG. 1, according to a preferred embodiment of the present invention. The bottom side 104 has a surface 204 suitable to receive identification indicia 202. Identification indicia 202 may be a monogram, as shown, or a name or symbol. Indicia-receiving bottom surface 204 may take up the entire bottom side 104, as shown, to form flat indicia-receiving bottom surface 204. "Flat" is meant to refer to a surface that appears to lie in a geometric plane. In an alternate embodiment, indicia-receiving bottom surface 204 may be a lesser portion of the bottom side 104. For example, a polished portion of the bottom surface 104 may be suitable for engraving indicia 202, while an unpolished portion may not be suitable for receiving indicia 202.

Figure 3:
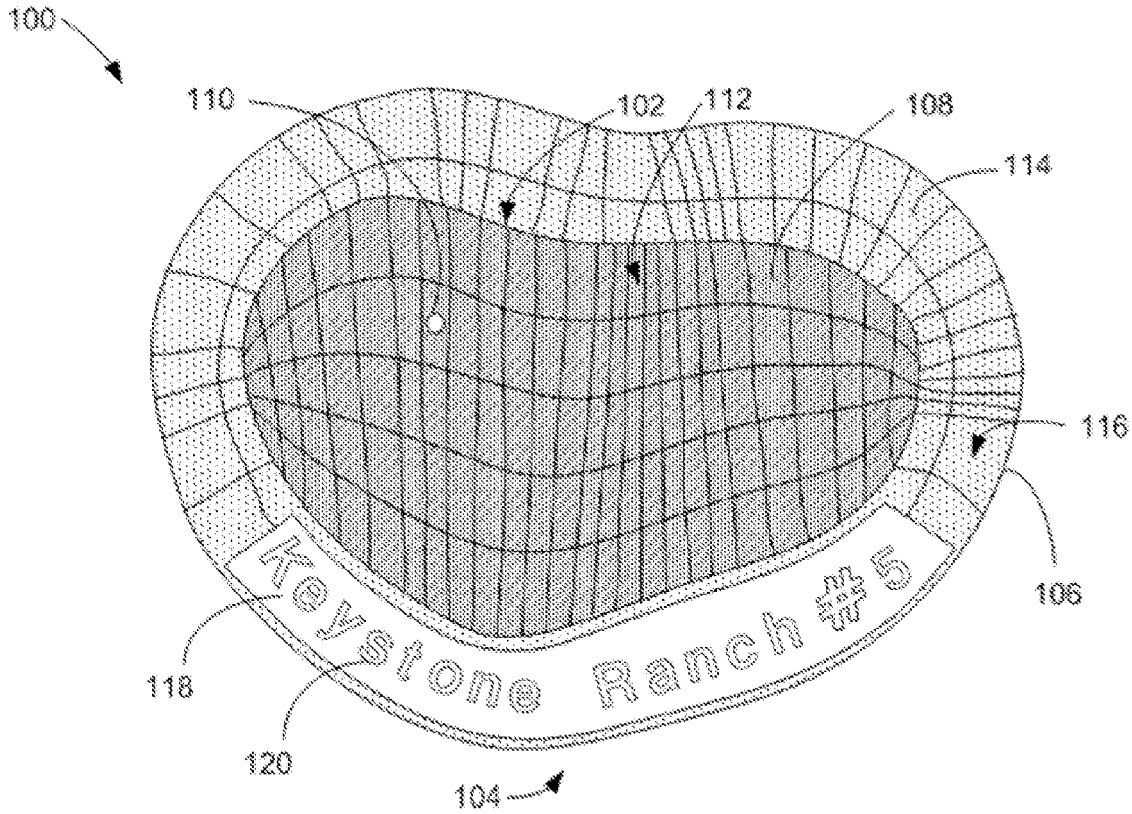
FIG. 3 is a top plan view illustrating the exemplary golf ball marker of FIG. 1, according to a preferred embodiment of the present invention.

FIG. 3 is a top plan view illustrating the exemplary golf ball marker 100 of FIG. 1, according to a preferred embodiment of the present invention. The top pan view emphasizes that there is no regular geometry required in the shape of the golf ball marker 100. Neither the perimeter 106, nor the contoured golf apron 114, nor the contoured golf green 108, nor the contours thereof, exhibit regular geometry. Rather, the contours, illustrated by the wire frame portions, follow the actual shape of the portion of the actual golf course being represented, and the perimeter 106 is shaped to aesthetically enclose the desired features of the portion of the actual golf course being represented.

Figure 4:
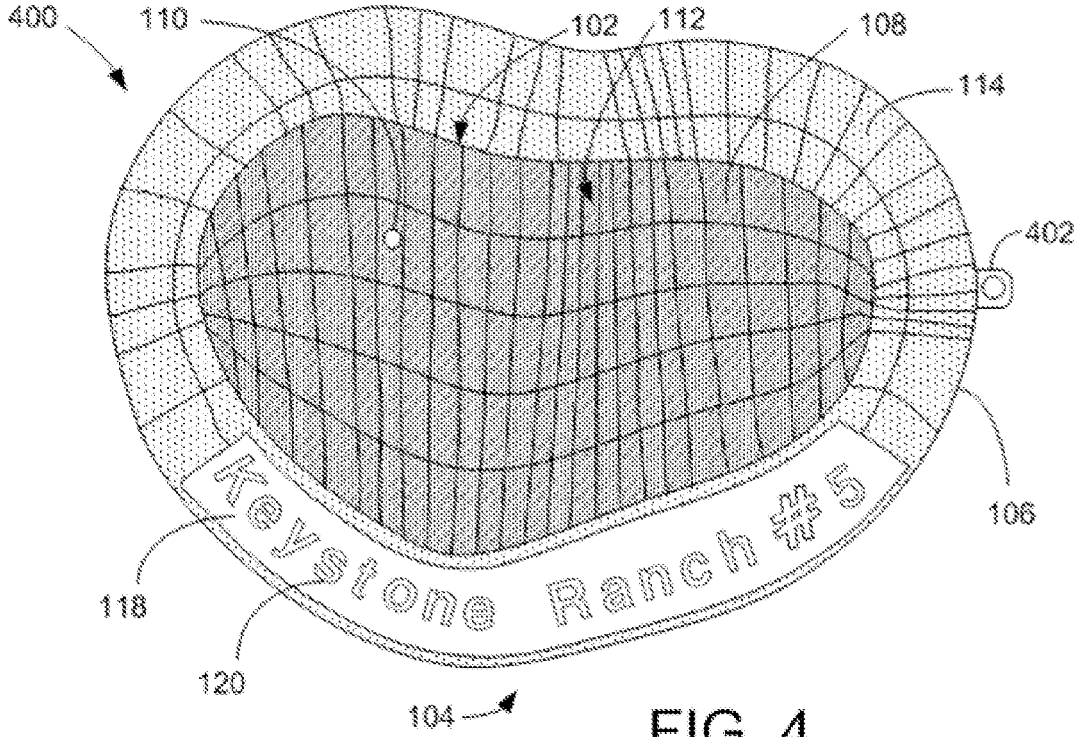
FIG. 4 is a top plan view illustrating a exemplary golf ball marker similar to that of FIG. 1, but with an added jewelry coupling, according to a second preferred embodiment of the present invention.

FIG. 4 is a top plan view illustrating a exemplary golf ball marker 400 similar to that of FIG. 1, but with an added jewelry coupling 402, according to a second preferred embodiment of the present invention. The jewelry coupling 402 is exemplary, and those of skill in the jeweler's art will, when enlightened by this disclosure, be aware of the various jewelry couplings that may be provided on the golf ball marker 400. In golf ball marker 400, it is preferred that the jewelry coupling 402 not extend below the geometric plane of the indicia-receiving bottom surface 204. Furthermore, the jewelry coupling 402 is exemplary of couplings generally, for various purposes, such as coupling to apparel or items of golf equipment. Regardless of the purpose, the generic coupling preferably does not extend below the bottom surface 104. The jewelry coupling 402 is preferably manufactured as part of the golf ball marker 400. In alternate embodiments, jewelry coupling 402 may be soldered or fastened to golf ball marker 100 by other means.

Figure 5A:
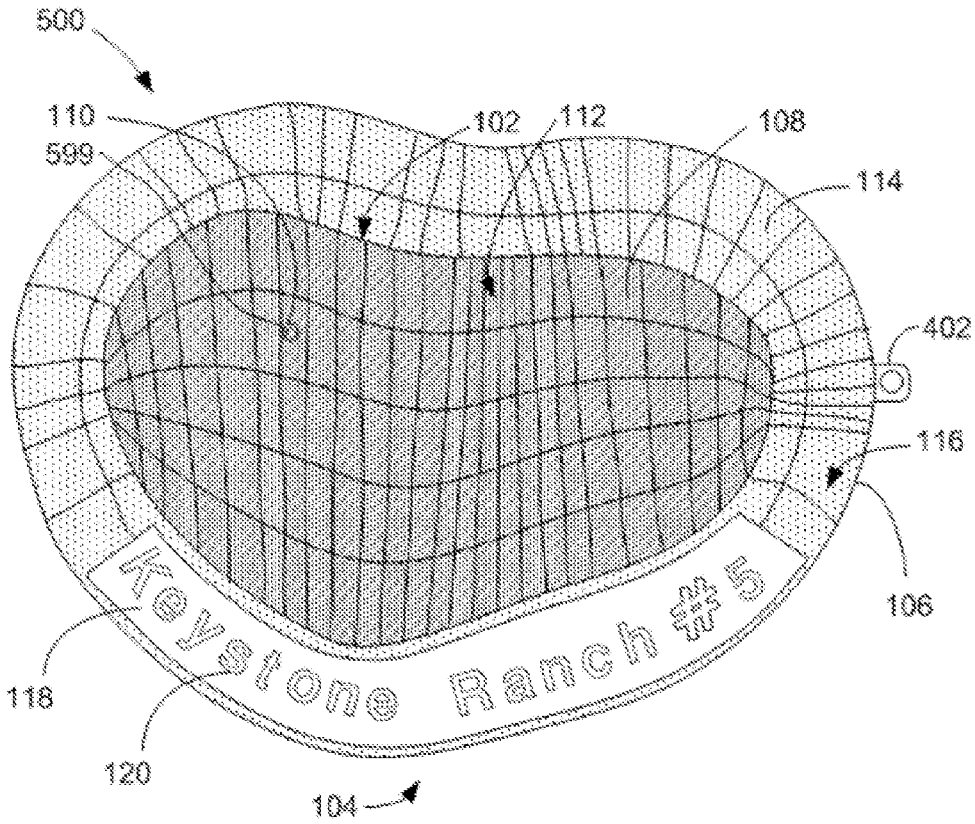
FIG. 5A is a top plan view illustrating the exemplary golf ball marker similar to that of FIG. 4, but with an added jewelry coupling, according to a second preferred embodiment of the present invention.

FIG. 5A is a top plan view illustrating the exemplary golf ball marker 500 similar to that of FIG. 4, but with an added decoration 599 for golf hole 110, according to a third preferred embodiment of the present invention. Decoration 599 is preferably a precious facetted gem and most preferably a cut and polished diamond. In various embodiments, customers may select or provide decorations 599 to their individual tastes. For non-limiting example, ruby, emerald, cubic zirconium, glass, rhinestones, ceramics, metals, plastics, semi-precious and even non-precious stones may be used in various embodiments. The decoration 599 may be attached with jeweler's cement or other adhesive appropriate to the materials being adhered. The decoration 599 is preferably countersunk to be flush with the surface of the contoured golf green 108. In an alternate embodiment, the decoration 702 (see FIG. 7) may extend above the surface of the contoured golf green 108.

Figure 5B:
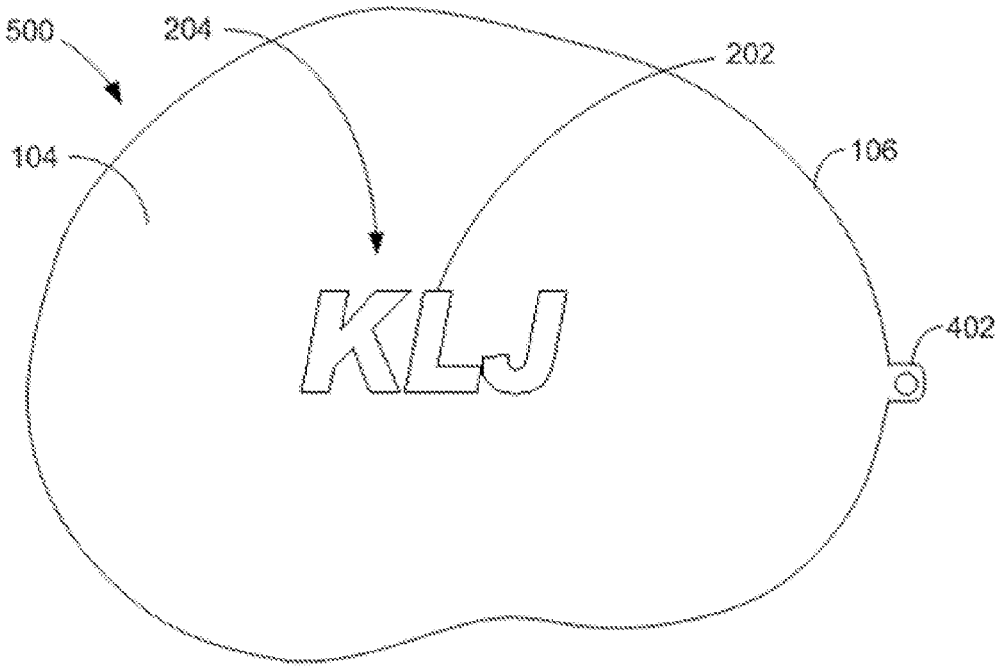
FIG. 5B is a bottom plan view illustrating the exemplary golf ball marker of FIG. 5A, according to a second preferred embodiment of the present invention.

FIG. 5B is a bottom plan view illustrating the exemplary golf ball marker 500 of FIG. 5A, according to the third preferred embodiment of the present invention. Indicia 202 may be engraved with mechanical tools or lasers. In a particular embodiment, the indicia 202 may be first engraved and then filled with a material (such as a precious metal) of contrasting color. In an alternate embodiment, the indicia 202 may be created in the mold for the golf ball marker 500. Those of skill in the art of engraving, etching, and plating, enlightened by the present disclosure, will recognize the various methods of applying indicia 202 to indicia-receiving bottom surface 204. In a particular embodiment, to indicia-receiving bottom surface 204 may encompass less than all of flat bottom side 104.

Figure 6:
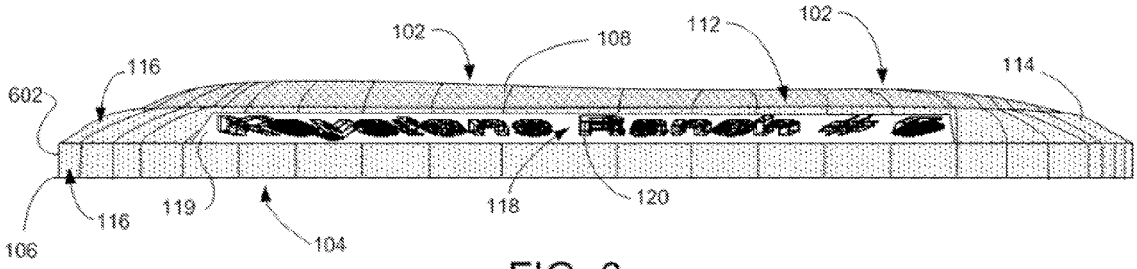
FIG. 6 is front elevation wireframe view with partial surface shading illustrating the exemplary golf ball marker of FIG. 4, according to a preferred embodiment of the present invention.

FIG. 6 is front elevation wireframe view with partial surface shading illustrating the exemplary golf ball marker 400 of FIG. 4, according to a preferred embodiment of the present invention. This embodiment shows a vertical edge 602 portion of the contoured top side 102 that follows the shape of perimeter 106. Perimeter 106 separates the contoured top side 102 from the flat bottom side 104. The relief lettering 120 is shown in wire frame without surface shading. In a particular embodiment, vertical edge 602 may be a remnant edge of a cut blank of metal that is machined to create contoured top side 102. Vertical edge has a golf apron texture 116, as shown.

Figure 7:
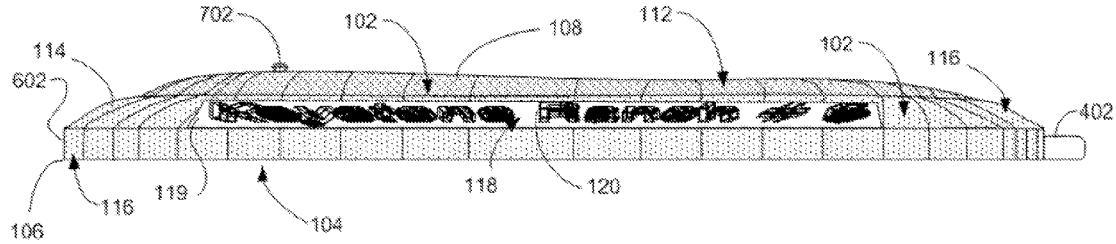
FIG. 7 is a front elevation wireframe view with partial surface shading illustrating the exemplary golf ball marker of FIG. 5, according to a preferred embodiment of the present invention.

FIG. 7 is a front elevation wireframe view with partial surface shading illustrating the exemplary golf ball marker 500 of FIG. 5, according to a preferred embodiment of the present invention. Decoration 702 extends above the surface of the contoured golf green 108, as shown. The bottom of jewelry coupling 402 is preferably flush with flat bottom side 104, as shown.

Figure 8:
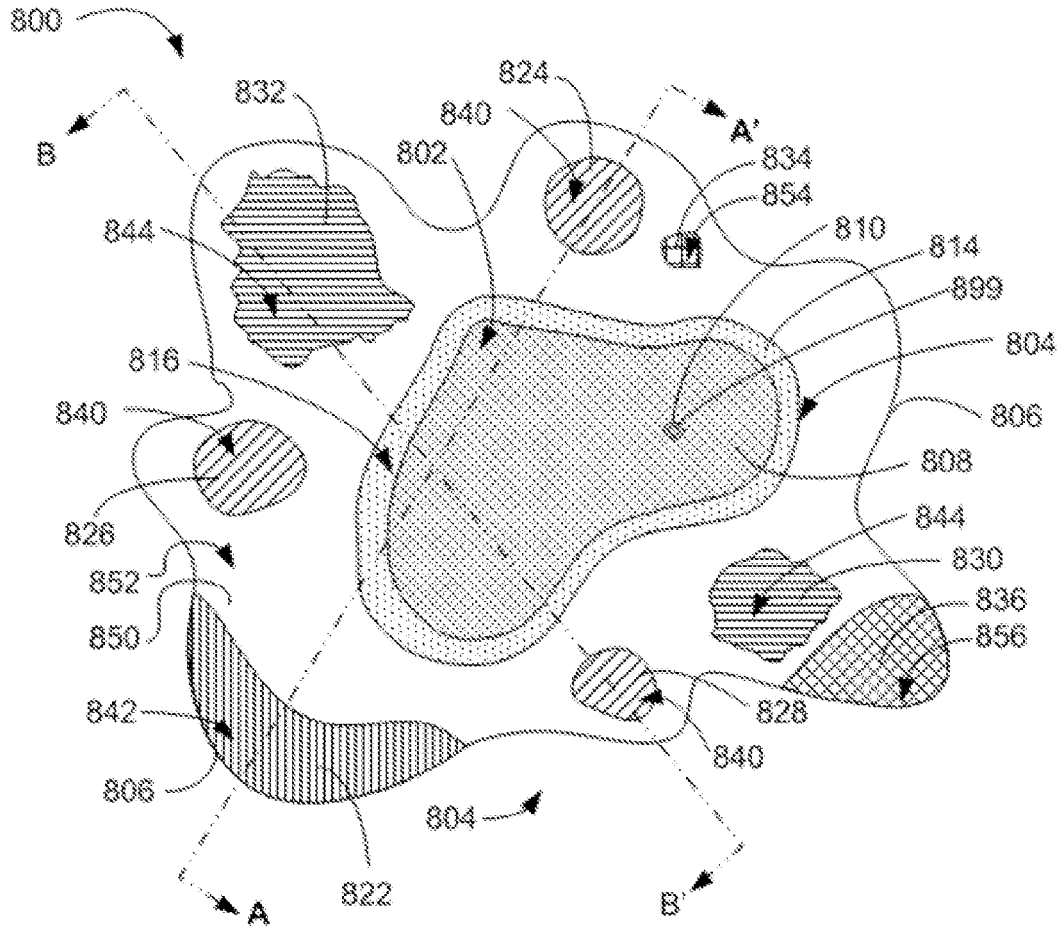
FIG. 8 is a top plan view illustrating a third exemplary embodiment of a golf ball marker, showing cross-section lines A-A' and B-B', according to a preferred embodiment of the present invention.

FIG. 8 is a top plan view illustrating a fourth exemplary embodiment of a golf ball marker 800, showing cross-section lines A-A' and B-B', according to a preferred embodiment of the present invention. FIG. 8 is based on a portion of the Ocotillo Golf Course in Chandler, Ariz., with a few liberties taken to illustrate types of golf course terrain not present there. FIG. 8 is shown without a name 118, panel 119, or perimeter-conformal lettering 120, which is preferred to have but may be omitted in particular embodiments. Golf ball marker 800 has a perimeter 806 and a flat bottom side 804, the latter of which is not visible in this view.

It is essential that each texture 802, 816, 840, 842, 844, 854, and 856 be visually distinct from each other texture, so that the variations in terrain will be apparent to the naked eye. Contoured golf green 808 has a golf green texture 802. Golf green texture 802 may, like the other textures 816, 840, 842, 844, 854, and 856, discussed below, be formed to closely imitate the actual textures of particular golf course terrains or may be merely symbolic. Some textures may be grouped into styles. For example, one style may literally be engraved fill patterns exactly like what is shown in FIG. 8, another style may used textures visually suggestive of the actual terrain (e.g. a sandy texture for sand trap texture 840), another style may use engraved map symbols as a type of texture. Styles may be selected by the customer when ordering a golf ball marker 100, 400, 500, 800 or 1100.

Golf hole 810 has a decoration 899, which may be as previously described for decorations 599 or 702. Contoured golf apron 814 has a visually distinct golf apron texture 816. Contoured fairway 850 has a visually distinct fairway texture 852. Contoured sand traps, or bunkers, 824, 826, and 828 have a visually distinct sand trap texture 840. Contoured wooded areas 830 and 832 have a visually distinct wooded area texture 844. Water hazard 822, which may be flat, has a visually distinct water hazard texture 842. Contoured environmental hazard 834, such as a rock (not present at the actual golf course) has a visually distinct environmental hazard texture 854. Contoured golf rough 836 (not present at the actual golf course) has a visually distinct golf rough texture 856.

Figure 9:
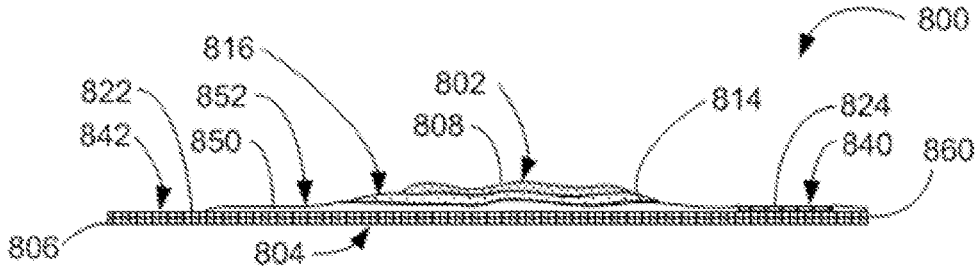
FIG. 9 is a cross-sectional cut-away elevation view in the A-A' cross-sectional plane illustrating a detail of the exemplary golf ball marker of FIG. 8, according to a preferred embodiment of the present invention.

FIG. 9 is a cross-sectional cut-away elevation view in the cross-sectional plane A-A' defined in FIG. 8 illustrating a detail of the exemplary golf ball marker 800 of FIG. 8, according to a preferred embodiment of the present invention. Perimeter 806 defines the boundary between contoured top side 802 and flat bottom side 804. Base portion 860, which may not be physically distinct from the remainder of golf ball marker 800, supports the lowest terrain representation which, in this case, is water hazard 822.

Water hazard 822 has a visually distinct water hazard texture 842, which may be, for non-limiting example, a mirror finish or a rippled surface. Contoured fairway 850 is contoured to extend above water hazard 822 and has a visually distinct fairway texture 852. Contoured golf apron 814 is contoured to extend above fairway 850 and has a visually distinct golf apron texture 816. Contoured golf green 808 is contoured to extend above contoured golf apron 814 and has a visually distinct golf green texture 802. Contoured sand trap 824 is contoured below the fairway 850 and has a visually distinct sand trap texture 840. In a particular embodiment, adapted to represent a particular portion of the actual golf course being represented, any terrain may be contoured make an accurate representation. For example, a particular portion of a golf course may have an elevated water hazard and a sunken golf green. Appropriate contouring to accurately represent such a relationship is preferred.

Figure 10:
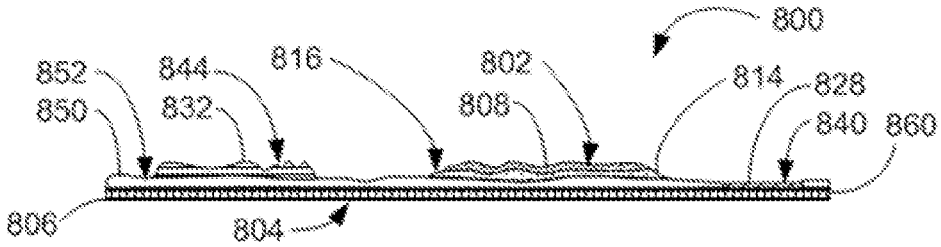
FIG. 10 is a cross-sectional cut-away elevation view in the B-B' cross-sectional plane illustrating a detail of the exemplary golf ball marker of FIG. 8, according to a preferred embodiment of the present invention.

FIG. 10 is a cross-sectional cut-away elevation view in the B-B' cross-sectional plane defined in FIG. 8 illustrating a detail of the exemplary golf ball marker 800 of FIG. 8, according to a preferred embodiment of the present invention. Perimeter 806 defines the boundary between contoured top side 802 and bottom side 804. Base portion 860, which may not be physically distinct from the remainder of golf ball marker 800, supports the lowest terrain representation which, in this case, is sand trap 828.

Contoured fairway 850 has a visually distinct fairway texture 852 that extends above base 860 beyond contoured wooded area 832, which has a visually distinct wooded area texture 844. Contoured golf apron 814, which has a visually distinct golf apron texture 816 extends above contoured fairway 850. Contoured golf green 808 is contoured to extend above contoured golf apron 814 and has a visually distinct golf green texture 802. Contoured sand trap 824 is contoured below the fairway 850 and has a visually distinct sand trap texture 840.

Contouring may be accomplished by molding, layering, carving, or machining, particularly with computer-aided-manufacturing (CAM). Texturing may be accomplished in a mold; with laser cutting, particularly with programmable lasers; by machining; by carving; or by etching.

Figure 11:
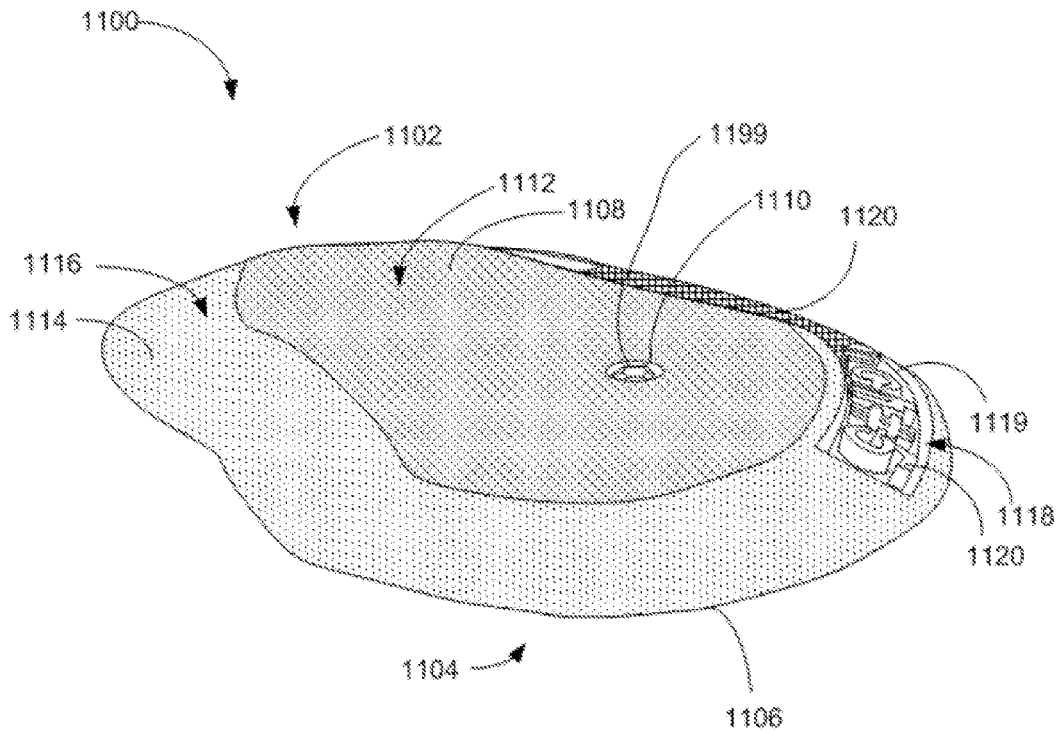
FIG. 11 is a top-front perspective view illustrating a fourth exemplary embodiment of a golf ball marker, according to a preferred embodiment of the present invention.

FIG. 11 is a top-front perspective view illustrating a fifth exemplary embodiment of a golf ball marker 1100, according to a preferred embodiment of the present invention. Contoured golf apron 1114 has a visually distinct golf apron texture 1116 and extends to a sharp-edged perimeter 1106. Perimeter 1106 defines a boundary between top side 1102 and bottom side 1104, which is not visible in this view. Bottom side 1104 is preferably similar to bottom side 104, in that it lies apparently in a geometric plane and provides an indicia-receiving surface but differs in shape if seen from a plan view. Contoured golf green 1108 lies within and above contoured golf apron 1114 and has a golf green texture 1112. Golf hole 1110 partially encloses decoration 1199, shown as a jewel. In another preferred embodiment, only the decoration 1199 represents the golf hole 1110, and no golf hole 1110, separate from the decoration 1199, is provided. Panel 1119 is contoured to the shape of a portion of perimeter 1106 and provides a name 1118 of the portion of the actual golf course being represented in lettering 1120, shown in partial detail and partial fill pattern. Golf ball marker 1100 is preferably made of a single piece of precious metal that is shaped, contoured, textured, and decorated.

Figure 12:
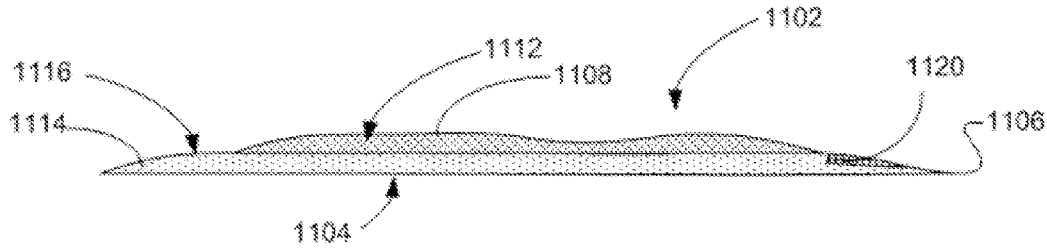
FIG. 12 is a front elevation view illustrating the fourth exemplary embodiment of the golf ball marker of FIG. 11, according to a preferred embodiment of the present invention.

FIG. 12 is a front elevation view illustrating the fifth exemplary embodiment of the golf ball marker 1100 of FIG. 11, according to a preferred embodiment of the present invention. The sharp edge of perimeter 1106, as shown, is an alternative to the vertical edge 602 of FIGS. 6 and 7. Contoured golf apron 1114 rises from the sharp-edged perimeter 1106 to the contoured golf green 1108.

Figure 13:
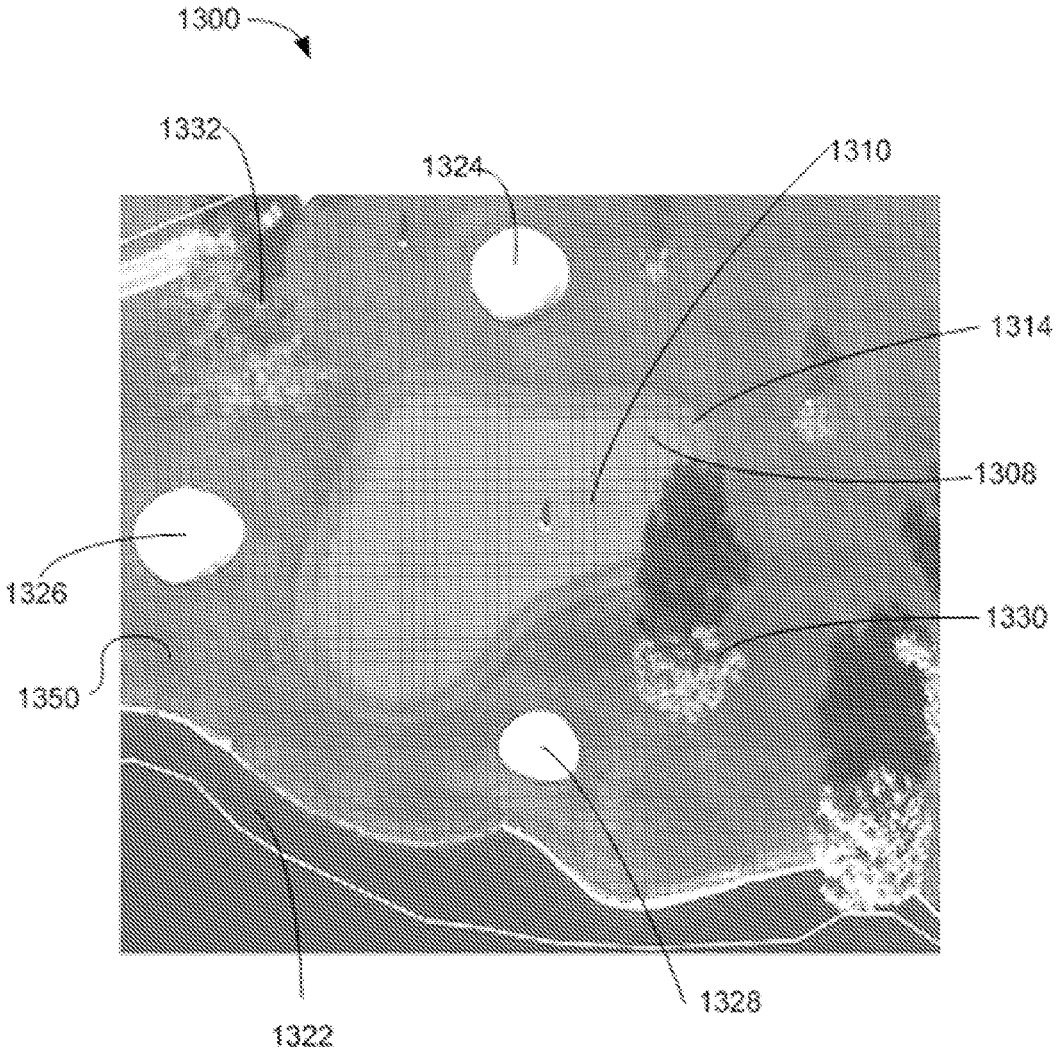
FIG. 13 is an overhead view of a digital data used in making the embodiment of FIG. 8, according to a preferred embodiment of the present invention.

FIG. 13 is an overhead image view illustrating exemplary digital data 1300 used in making the golf ball marker 800 of FIG. 8, according to a preferred embodiment of the present invention. Digital data 1300 may be obtained from various sources, such as Google Earth™; various commercial satellite photography services; or dedicated digital photography resources. Digital data 1300 preferably includes contouring information, which may be obtained from Google Earth™; dedicated topographical mapping resources (terrestrial or airborne); or GPS mapping of the golf course by golfers or by golf course personnel. GPS receivers can provide latitude, longitude, and elevation above mean sea level for each of a plurality of points on the golf course, and the plurality of points may be used to form a contour digital map. Use of differential GPS can improve the results or reduce the time needed to collect data, as desired.

The digital data 1300 of the portion of the actual golf course being represented shows fairway 1350, wooded areas 1330 and 1332, golf green 1308, golf apron 1314, golf hole 1310; and water hazard 1322. Each of the reference numbers in FIG. 13 corresponds, in their last two digits, to portions of the golf ball marker 800 illustrated in FIGS. 8-10. Approximate contour and elevation data may be obtained by viewing a Google Earth™ image from a low zenith angle. More exact contour information may be obtained by contracting with the data source for Google Earth™, or similar geographic information provider, to build a contour map that can be translated into a 3D CAD design and then sent to a 3D CAM plant.

Figure 14:
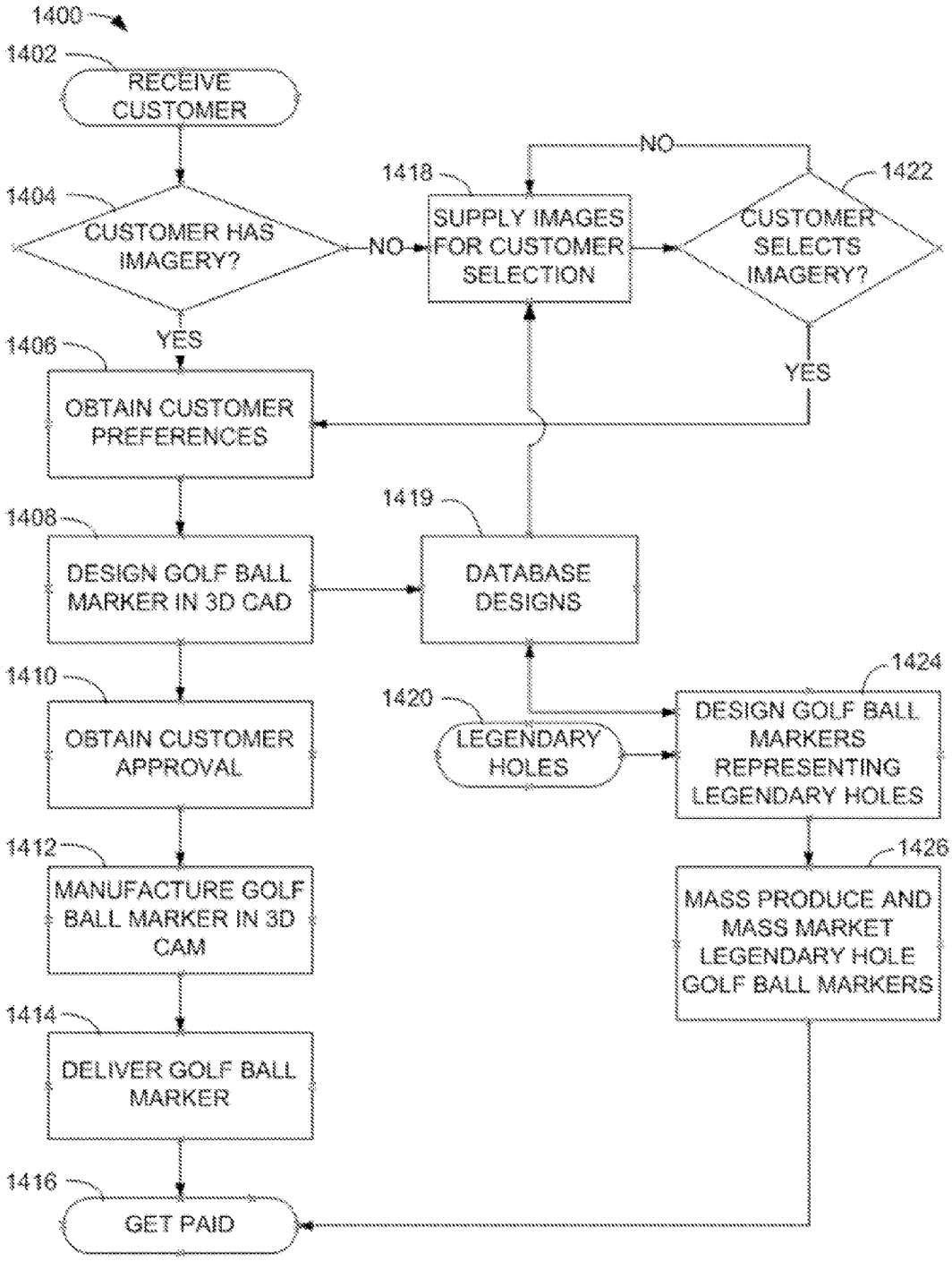
FIG. 14 a process diagram illustrating an exemplary method of conducting a business of producing and selling golf ball markers, to a preferred embodiment of the present invention.

FIG. 14 is a process diagram illustrating an exemplary method 1400 of conducting a business of producing and selling golf ball markers 100, 400, 500, 800, 1100, and other embodiments within the scope of this disclosure (hereinafter "golf ball marker"), according to a preferred embodiment of the present invention. Method 1400 begins in step 1402, where the business for producing and selling golf ball markers receives customer contact. Various methods of making contact with customers are included. For example and without limitation, the customer may contact a website of the business, may make contact with sales personnel in a golf shop, or may make contact through a catalog sales office of the business. An initial question 1404 for the golf ball marker customer is whether the customer has digital imagery, such as digital imagery 1300, representative of the portion of the actual golf course to be represented with the golf ball marker. If the customer has digital data 1300, then the preferences of the customer are obtained 1406 by the business. The customer's preferences may include, for non-limiting examples, the type of material that the golf ball marker will be made of; whether or not a jewelry coupling 402 is desired; what type of decoration 599, 702, 1199, or other decoration within the scope of the present disclosure, is desired; what perimeter 106, 806, 1106, or other perimeter within the scope of this disclosure, shape is desired; and what textures or styles may be desired. Once the digital data 1300 and the customer preferences are obtained, the golf ball marker is designed 1408, preferably using a three-dimensional computer aided design (3D CAD) tool such as AutoCAD® or the like. In step 1410, customer approval for the design is obtained, preferably by showing the customer a three-dimensional rendered image of the design. Once customer approval is obtained, the golf ball marker is manufactured 1412, preferably using three-dimensional computer-aided-manufacturing (3D CAM). The manufactured golf ball marker is then delivered 1414 to the customer, and the business gets paid 1416. Preferably, each 3D CAD design is saved 1419 in a database which associates the name of the golf course and the hole represented in the design with the design. This can simplify and economize other orders for golf ball markers for the same portion of the actual golf course being represented.

If the customer does not have digital data 1300, the business supplies digital data 1300 for the customer to select 1418. The business may obtain this digital data 1300 from its own database of designs formed in step 1419, from commercial data suppliers, or may, in a particular embodiment of the business, obtain the digital data 1300 for the customer by operating digital data acquisition instruments of its own. Imagery based on the digital data 1300 is presented to the customer for selection in step 1418. If the customer does not select 1422 imagery, additional imagery may be supplied. If the customer does not select 1422 any of the available imagery, the contact with the customer is terminated (not shown) or an order to obtain imagery is received from the customer and filled as part of step 1418. Once the customer has selected 1422 imagery in step 1422, the method enters step 1406 and proceeds as described above.

Step 1420 is an alternate starting point for the business method. Step 1420 recognizes that there are legendary, or at least famous, holes in the lore and legend of golf that are likely to be popular with customers, independent of individual orders. For example, the Tournament Player's Club Sawgrass seventeenth hole, illustrated in a Wikpedia article on golf courses, may be a legendary hole. Legendary holes may appear in the database of designs formed in step 1419, where the number of individual orders for a particular hole on a particular course indicates mass market appeal. In step 1424 golf ball markers are designed for one or more legendary holes. In step 1426, the golf ball markers representing legendary holes are mass produced and mass marketed, resulting in step 1416, where the business gets paid.

Although applicant has described applicant's preferred embodiments of this invention, it will be understood that the broadest scope of this invention includes modifications such as diverse shapes, sizes, and materials. For example, and without limitation, the teachings of this disclosure may be applied to golf ball markers of various shapes and sizes, such as a golf ball marker having a top side contoured by having topographical map lines engraved on an otherwise flat surface. Such scope is limited only by the below claims as read in connection with the above specification. Further, many other advantages of applicant's invention will be apparent to those skilled in the art from the above descriptions and the below claims.

I claim:

1. A golf ball marker comprising:

a. a top side shaped to form a contoured representation of a portion of an actual golf course;

b. a bottom side having a surface suitable to receive identification indicia; and c. a perimeter, shaped adaptively to said portion of such actual golf course and defining a boundary between said top side and said bottom side;

d. wherein said contoured representation of said portion of such actual golf course comprises a plurality of textures.

2. The golf ball marker of claim 1, wherein said top side comprises a name of said portion of said actual golf course in lettering.

3. The golf ball marker of claim 2, wherein said lettering is arranged proximate to said perimeter.

4. The golf ball marker of claim 3, wherein said lettering is arranged conformal to said perimeter.

5. The golf ball marker of claim 2, wherein said lettering is in relief.

6. The golf ball marker of claim 1, wherein said perimeter appears to be in a geometric plane defined by said bottom side that is rigidly flat.

7. The golf ball marker of claim 1, wherein said portion of an actual golf course comprises a plurality of representations of golf holes.

8. The golf ball marker of claim 1, wherein said plurality of textures comprises at least two visually distinct textures representing golf course features from the group of:

a. a golf green;

b. a golf apron c. a fairway;

d. a sand trap;

e. a rough;

f. a water hazard;

g. a wooded area; and h. an environmental obstacle.

9. The golf ball marker of claim 1, wherein said contoured representation of said portion of such actual golf course comprises a representation of a golf green.

10. The golf ball marker of claim 9, wherein said representation of a golf green comprises a representation of a golf hole.

11. The golf ball marker of claim 10, wherein said representation of said golf hole comprises a decoration.

12. The golf ball marker of claim 1, wherein said identification indicia comprises personal identification indicia.

13. The golf ball marker of claim 12, wherein said personal identification indicia comprises one of:

a. a name of an owner of said golf ball marker; and b. a monogram of an owner of said golf ball marker.

14. The golf ball marker of claim 1, further comprising a coupling extending outward of said perimeter from said top side adjacent to said perimeter.

15. The golf ball marker of claim 1, wherein said contoured representation of a portion of such actual golf course is derived from digital imagery of said portion of such actual golf course.

16. The golf ball marker of claim 15, wherein said digital imagery is one of provided and selected by a person desiring to have said golf ball marker produced.

17. A golf ball marker comprising:

a. a top side comprising:

i. a contoured representation of a portion of an actual golf course further comprising a plurality of textures; and ii. a name relating to said portion of said actual golf course in lettering;

b. a bottom side having a surface suitable to receive identification indicia; and c. a perimeter shaped adaptively to said portion of such actual golf course and defining a boundary between said top side and said bottom side, wherein said lettering is at least one of proximate said perimeter and arranged conformally to said perimeter.

18. The golf ball marker of claim 17, wherein said contoured representation of said portion of such actual golf course comprises a representation of a golf green further comprising a representation of a golf hole, said representation of a golf hole comprising a decoration.

19. The golf ball marker of claim 17, wherein said contoured representation of a portion of such actual golf course is derived from digital imagery of said portion of such actual golf course, wherein said digital imagery is one of provided and selected by a person desiring to have said golf ball marker produced.

20. A golf ball marker comprising:

a. a top side comprising:

i. a contoured representation of a portion of an actual golf course;

ii. a name relating to said portion of said actual golf course in relief lettering; and iii. a plurality of visually distinct textures representing various portions of golf course terrain;

b. a bottom side having a surface suitable to receive identification indicia; and c. a perimeter shaped adaptively to said portion of such actual golf course and defining a boundary between said top side and said bottom side, wherein said lettering is at least one of proximate said perimeter and arranged conformally to said perimeter;

d. a jewelry coupling extending outwardly of said perimeter from said top side adjacent to said perimeter;

e. wherein said contoured representation of said portion of such actual golf course comprises a representation of a golf green further comprising a representation of a golf hole, said representation of a golf hole comprising a decoration;

f. wherein said contoured representation of a portion of such actual golf course is derived from digital imagery of said portion of such actual golf course, wherein said digital imagery is one of provided and selected by a person desiring to have said golf ball marker produced, wherein if selected, said digital imagery is selected from a database of digital imagery representing at least one of designs for previous customers and designs for legendary golf holes.

* * * * *